US012765729B2

(12) United States Patent
Brada et al.

(10) Patent No.: US 12,765,729 B2
(45) **Date of Patent: *Oct. 20, 2026**

(54) SUPPLYING LIQUID TO AT LEAST ONE WHEEL OF A SUCTION HEAD

(71) Applicant: VERSUNI HOLDING B.V., Eindhoven (NL)

(72) Inventors: IJpe Bernardus Brada, Eindhoven (NL); Fermín Espín Franco, Eindhoven (NL)

(73) Assignee: VERSUNI HOLDING B.V., Eindhoven (NL)

( * ) Notice: Subject to any disclaimer, the term of this patent is extended or adjusted under 35 U.S.C. 154(b) by 483 days.

This patent is subject to a terminal disclaimer.

(21) Appl. No.: 18/282,471

(22) PCT Filed: Mar. 11, 2022

(86) PCT No.: PCT/EP2022/056407
§ 371 (c)(1),
(2) Date: Sep. 15, 2023

(87) PCT Pub. No.: WO2022/194717
PCT Pub. Date: Sep. 22, 2022

(65) Prior Publication Data

US 2024/0148205 A1 May 9, 2024

(30) Foreign Application Priority Data

Mar. 17, 2021 (EP) ..... 21163060

(51) Int. Cl.
*A47L 9/00* (2006.01)
*A47L 7/00* (2006.01)
(Continued)

(52) U.S. Cl.
CPC ..... *A47L 9/009* (2013.01); *A47L 7/0004* (2013.01); *A47L 9/0477* (2013.01);
(Continued)

(58) Field of Classification Search
CPC ..... A47L 9/009; A47L 7/0004; A47L 9/0477; A47L 11/302; A47L 11/4072; A47L 11/408
See application file for complete search history.

(56) References Cited

U.S. PATENT DOCUMENTS 3,753,268 A * 8/1973 Bayless ..... A47L 9/0488 15/384
4,654,916 A * 4/1987 Postonen ..... A47L 11/4083 15/50.3
(Continued)

FOREIGN PATENT DOCUMENTS

CN 104352206 A * 2/2015
CN 108903798 A * 11/2018 ..... A47L 9/0411
(Continued)

OTHER PUBLICATIONS

Extended European Search Report issued in connection with corresponding EP Application No. 21163060.3 dated Sep. 10, 2021.

*Primary Examiner* — Marc Carlson
(74) *Attorney, Agent, or Firm* — Maschoff Brennan

(57) ABSTRACT

In the context of vacuum cleaning, a suction head is provided, which includes a housing that has a coupling area that enables coupling of the housing to an air suction source of a vacuum cleaner, at least one brush that is rotatably arranged in the housing to interact with a surface to be cleaned, and at least one wheel that is rotatably arranged on the suction head to be in contact with the surface. The suction head is further equipped with a wetting arrangement that enables a direct supply of liquid to the at least one wheel
(Continued)

and to thereby achieve the effect that the at least one wheel is kept wet and the cleaning results of the surface to be cleaned are optimized.

15 Claims, 7 Drawing Sheets

(51) Int. Cl.
*A47L 9/04* (2006.01)
*A47L 11/30* (2006.01)
*A47L 11/40* (2006.01)

(52) U.S. Cl.
CPC ..... *A47L 11/302* (2013.01); *A47L 11/4072* (2013.01); *A47L 11/408* (2013.01)

(56) References Cited

U.S. PATENT DOCUMENTS 5,086,539 A * 2/1992 Rench ..... A47L 5/30 15/384
6,030,465 A * 2/2000 Marcussen ..... A47L 11/4041 15/384
6,662,402 B2 * 12/2003 Giddings ..... A47L 11/4011 15/384
7,392,566 B2 * 7/2008 Gordon ..... A47L 11/34 15/322
2003/0051310 A1 * 3/2003 Morgan ..... A47L 5/28 15/412
2003/0159232 A1 * 8/2003 Hekman ..... A47L 11/4011 15/320
2008/0092325 A1 * 4/2008 Vander Baan ..... A47L 11/4002 15/328
2012/0284950 A1 * 11/2012 De Wit ..... A47L 11/34 15/52
2013/0305468 A1 * 11/2013 De Wit ..... A47L 11/40 15/49.1
2014/0289999 A1 * 10/2014 Gilbert, Jr. ..... A47L 7/02 15/347
2018/0289226 A1 * 10/2018 De Wit ..... A47L 9/0405
2018/0296046 A1 * 10/2018 Thorne ..... A47L 9/0405
2019/0082911 A1 * 3/2019 Conrad ..... A47L 11/34
2019/0150686 A1 * 5/2019 Horne ..... A47L 9/02
2019/0183311 A1 * 6/2019 Diana ..... A47L 7/0023
2019/0191947 A1 * 6/2019 Freese ..... A47L 9/0488
2019/0193120 A1 * 6/2019 Brown ..... A47L 9/0613
2020/0015646 A1 * 1/2020 Gilbert, Jr. ..... A47L 11/4063
2020/0060503 A1 * 2/2020 Davila ..... A47L 11/201
2021/0298554 A1 * 9/2021 Resch ..... A47L 11/302
2024/0032763 A1 * 2/2024 Brada ..... A47L 5/30
2024/0156311 A1 * 5/2024 Espín Franco ..... A47L 11/4041
2024/0341549 A1 * 10/2024 Carter ..... A47L 9/0405

FOREIGN PATENT DOCUMENTS

CN 108968800 A * 12/2018 ..... A47L 9/04
CN 109431371 A * 3/2019 ..... A47L 9/04
CN 109602330 A * 4/2019 ..... A47L 9/0477
CN 110353564 A * 10/2019 ..... A47L 9/04
EP 1654974 A1 * 5/2006 ..... A47L 11/4036
JP H0910143 A * 1/1997
JP 2007513659 A * 5/2007 ..... A47L 11/292
JP 4519140 B2 8/2010
JP 2018531662 A 11/2018
JP 2020199295 A * 12/2020 ..... A47L 9/2873
RU 2543427 C2 2/2015
TW M575692 U 3/2019
WO WO-2011083373 A1 * 7/2011 ..... A47L 11/4041
WO WO-2012107876 A1 * 8/2012 ..... A47L 11/302
WO WO-2016096037 A1 * 6/2016 ..... A47L 9/0411
WO WO-2019040623 A2 * 2/2019 ..... A47L 9/0444
WO WO-2020213075 A1 * 10/2020 ..... A47L 9/04
WO WO-2021064420 A1 * 4/2021 ..... A47L 9/0488
WO WO-2022010083 A1 * 1/2022 ..... A47L 9/0477

* cited by examiner

SUPPLYING LIQUID TO AT LEAST ONE WHEEL OF A SUCTION HEAD

CROSS-REFERENCE TO RELATED APPLICATIONS

The present application is a U.S. National Phase application under 35 U.S.C. § 371 of International Application No. PCT/EP2022/056407, filed on Mar. 11, 2022, which claims the benefit of European Patent Application No. 21163060.3, filed on Mar. 17, 2021. These applications are hereby incorporated by reference herein.

FIELD OF THE INVENTION

The invention relates to a suction head configured to be applied in a vacuum cleaner and to perform a cleaning action on a surface, the suction head comprising: a housing that includes a coupling area configured to enable coupling of the housing to an air suction source of the vacuum cleaner, at least one brush that is rotatably arranged in the housing and that is configured to interact with the surface to be cleaned, and at least one wheel that is rotatably arranged on the suction head and that is configured to be in contact with the surface to be cleaned.

Further, the invention relates to a cordless vacuum cleaner comprising a suction head as mentioned.

BACKGROUND OF THE INVENTION

Vacuum cleaners are known for removing dirt from a surface to be cleaned. The term "dirt" as used in the present text is to be understood so as to cover any contamination as may be present on a surface and that can be removed under the influence of a vacuum cleaning action, probably combined with another cleaning action such as mopping. Practical examples in this respect include dust and small particles of any kind, and also wet types of contamination such as spilled drinks. A practical example of the surface to be cleaned is a floor, wherein the floor may be of any kind, such as a wooden floor, a carpet floor, a tile floor, etc.

Generally, a vacuum cleaner has a vacuum cleaner head or suction head, which is the part of the vacuum cleaner where the actual process of picking up dirt from a surface to be cleaned is to take place and which is therefore to be put on or at least close to the surface. Further, a vacuum cleaner normally comprises a body portion including a dirt accumulating area, and an arrangement configured to act on the suction head so that a suction force is prevailing in the suction head during operation of the vacuum cleaner. The suction force serves to facilitate transport of dirt that is picked up from the surface during operation of the vacuum cleaner towards the dirt accumulating area, wherein the dirt is made to pass an outlet opening in a housing of the suction head. The suction force may also have a function in the actual process of picking up the dirt from the surface. On the other hand, the suction head may be equipped with at least one movable component for interacting with the surface in order to pick up the dirt, such as at least one rotatable brush that may serve as an agitator of the dirt and that may particularly be configured to help dislodge dirt from the surface and direct it towards the outlet opening.

WO 2011/083373 A1 discloses a cleaning device for removing particles from a surface, comprising spraying means for spraying droplets of a work fluid, a rotatable brush having flexible brush elements, an inlet for receiving dirtied air such as air laden with particles, and a cleansing unit. The cleansing unit is suitable for separating at least a portion of the droplets of work fluid from the air. During operation, the rotatable brush is wetted by the work fluid. The brush is of such a dimension and is rotated at such a rotational speed that the droplets of the work fluid are expelled as a mist of droplets from the flexible brush elements into a coalescing space of the device. The dirtied air received by the inlet is receivable by the coalescing space, to form coalesced particles of the droplets expelled from the brush elements and particles in the dirtied air, the coalesced particles being conveyable from the coalescing space to the cleansing unit. The cleaning device comprises a housing that accommodates the brush at the one side thereof and that has a handle at the other side thereof, which handle is suitable to be taken hold of by user. The housing is provided with wheels keeping a rotation axle of the brush at a predetermined distance of the surface to be cleaned.

WO 2012/107876 A1 discloses a cleaning device comprising a head having an open side for facing surfaces to be cleaned, and at least one brush for contacting surfaces to be cleaned, which is rotatably arranged in the head. The at least one brush is provided with a plurality of brush hairs, wherein it is possible that these brush hairs are extremely soft and flexible. In such a case, a cleaning action of a surface is not performed by scrubbing the surface but by putting the brush hairs alternately in and out of contact with the surface during rotation of the brush. In particular, during one revolution of the brush, the brush hairs remove particles and/or liquid droplets from a soiled surface and fling away the particles and/or the droplets when they reach a position in which they are free from contact to the surface and in which they can be fully outstretched. In the head of the cleaning device, in which the brush is arranged, there are means for receiving the particles and/or the droplets, and for possibly transporting the particles and/or the droplets towards a space where they are collected. The cleaning device may be equipped with means for realizing a suction force at the head in order to direct the particles and/or the droplets in a desired direction once they are released from the brush hairs. Further, it is possible that the cleaning device is configured to supply a cleaning liquid to the rotating brush in order to promote the adherence of particles to the brush hairs and/or to realize an additional cleaning effect on a surface to be cleaned. The cleaning device comprises wheels for supporting the head and allowing the head to roll along surfaces to be cleaned.

In the context of the invention, it is acknowledged that especially in the field of wet vacuum cleaning, it happens that wheels of the suction head get polluted with dust, grime, hairs etc., even to such an extent that the wheels leave stains/marks/stripes on the surface to be cleaned. Thus, pollution of the wheels is found to be a factor that may cause the cleaning result on the surface to be cleaned to be less optimal.

US 2008/092325A1 discloses a bare floor cleaner capable of wet pickup through a first nozzle opening with the aid of a squeegee, wet scrubbing with an agitator, and dry pickup through a second nozzle opening. The bare floor cleaner comprises a dual-path nozzle assembly having a wet suction path in communication with the first nozzle opening and a dry suction path in communication with the second nozzle opening. A diverter valve selectively controls fluid communication between a suction source and one of the first and second nozzle openings for conversion between wet and dry modes. The bare floor cleaner further comprises a single actuator that controls the positions of the agitator and of the diverter valve.

SUMMARY OF THE INVENTION

It is an object of the invention to provide a practical way of preventing the cleaning result of a vacuum cleaning action performed on a surface from being less optimal due to pollution of the wheels of the suction head that is used in performing the action.

In view of the foregoing, the invention provides a suction head configured to be applied in a vacuum cleaner and to perform a cleaning action on a surface, the suction head comprising: a housing that includes a coupling area configured to enable coupling of the housing to an air suction source of the vacuum cleaner, at least one brush that is rotatably arranged in the housing and that is configured to interact with the surface to be cleaned, at least one wheel that is rotatably arranged on the suction head and that is configured to be in contact with the surface to be cleaned, and a wetting arrangement that is arranged and configured to enable a direct supply of liquid to the at least one wheel.

It follows from the foregoing definition of the suction head according to the invention that the invention involves equipping the suction head with a wetting arrangement that is arranged and configured to enable a direct supply of liquid to the at least one wheel. A notable advantage of doing so is that cleaning of the at least one wheel can take place automatically, without a need for action from the side of the user and without a need for external cleaning tools nor tools for dismantling the components of the suction head. Thus, the invention provides a very reliable way of keeping the at least one wheel of the suction head clean and thereby avoiding a situation in which the at least one wheel might be of influence on the cleaning result. With the direct supply of liquid to the at least one wheel, it can be ensured that the at least one wheel receives a continuous supply of liquid and that right from the start of the operation of the suction head, accumulation of dirt on the at least one wheel cannot occur, which does not mean that having a continuous supply of liquid throughout operation is essential in the context of the invention, as it is also possible to have a supply of liquid only from time to time. It is practical if the direct supply of liquid involves a continuous or intermittent flow of liquid, or spray of liquid, directed towards the at least one wheel. The wetting arrangement can be provided more or less as an add-on to an existing design of a suction head, but it is also possible that the wetting arrangement is provided in a more integrated fashion. A practical example of the liquid is water or a mixture of water and a cleaning agent.

In a practical embodiment of the suction head according to the invention, the wetting arrangement is arranged and configured to enable a direct supply of liquid to the at least one wheel at the position of the tread of the at least one wheel, from outside of the at least one wheel. In this embodiment, the at least one wheel can simply be of conventional design and made up of one or more conventional materials such as plastic and rubber, and the at least one wheel can be mounted in the suction head in any suitable known way. The rotating movement of the wheel can be used to advantage when it comes to spreading the liquid over the entire tread of the wheel.

It is practical if the wetting arrangement comprises a conduit system configured to transport liquid and to let out liquid to the at least one wheel. For example, the conduit system may be configured to let out liquid to the at least one wheel at a position right above the at least one wheel.

Especially when the wetting arrangement is used to supply liquid to more than one wheel, it may be advantageous if the above-mentioned conduit system comprises at least one main conduit and at least one branch conduit that is coupled to the at least one main conduit and that extends from the at least one main conduit towards the at least one wheel. In such a case, the main conduit may serve as a kind of buffer and/or distributor of the liquid. In order to control the flow of liquid from the at least one main conduit to the at least one branch conduit, it may be helpful if a restricted liquid passage is present at an interface of the at least one main conduit and the at least one branch conduit. In an advantageous embodiment, the suction head comprises a restriction element in fluid communication with the at least one main conduit and the at least one branch conduit, wherein the restriction element is provided with at least one restriction opening configured to allow liquid to pass in a direction from the at least one main conduit towards the at least one branch conduit. In such an embodiment, it may be so that the restriction element or an assembly of components in which the restriction element is included is removably arranged in the suction head. This allows for easy cleaning of the restriction element in order to avoid clogging of the at least one restriction opening of the restriction element.

An additional measure aimed at keeping the at least one wheel clean involves arranging the at least one wheel so that the rotating brush is enabled to interact with the wheel during operation of the suction head. A further effect of this measure may be that a portion of the brush that is near the wheel is wetted to some extent by the wheel. This measure can also be applied independently of having the wetting arrangement. In view thereof, the invention also provides a suction head configured to be applied in a vacuum cleaner and to perform a cleaning action on a surface, the suction head comprising: a housing that includes a coupling area configured to enable coupling of the housing to an air suction source of the vacuum cleaner, at least one brush that is rotatably arranged in the housing and that is configured to interact with the surface to be cleaned, and at least one wheel that is rotatably arranged on the suction head and that is configured to be in contact with the surface to be cleaned, wherein the at least one wheel is arranged so that the rotating brush is enabled to interact with the wheel during operation of the suction head.

In the case that the suction head comprises at least two wheels, it is possible that the wetting arrangement is arranged and configured to enable a direct supply of liquid to at least some of the wheels. In particular, it may be practical to especially keep wheels which are at a front position on the suction head clean by means of the wetting arrangement, without also having a supply of liquid to wheels which are at a trailing position on the suction head. In general, an embodiment of the suction head is feasible in which the suction head comprises a number of wheels and in which a direct supply of liquid only takes place on those wheels which are more prone to pollution. This will help in keeping the suction head as lightweight as possible and avoids a bulky design of the suction head.

The wetting arrangement can be used for other purposes besides wetting the at least one wheel. For example, it is possible that the wetting arrangement is further arranged and configured to enable a direct supply of liquid to at least one area of the surface to be cleaned. In this way, the wetting arrangement may function to directly wet the surface to be cleaned and to indirectly wet the at least one brush. In this respect, it may be advantageous if the wetting arrangement is arranged and configured to let out liquid to at least one area of the surface to be cleaned at a position of a bottom surface portion of the suction head being at a level that is at least 2 mm and at most 6 mm above a level of the lowest position of the at least one wheel. In that way, a cleaning effect on the bottom surface portion may be obtained, because the bottom surface portion is not exposed to the dirt that is flung away by the brush and liquid can bridge the distance by surface tension. Keeping the bottom surface portion clean is helpful in optimizing cleaning results of the surface to be cleaned.

In case the suction head comprises two brushes, it may be so that the brushes are arranged substantially parallel to each other, and that the at least one wheel is located in an area between the brushes. Further, in that case, it may be so that the suction head comprises an elongated intermediate component that is located in an area between the brushes and that optionally comprises two portions configured to cover portions of the brushes. It is practical if, at the position of a top side thereof, the elongated intermediate component is suspended from a portion of the housing of the suction head. Covering as much as possible of the brushes, preferably at a very close range, is beneficial when it comes to effectively invoking the suction force in the suction head. The elongated intermediate component may be an integral part of the housing or may be provided as a separate component that could be removably coupled to another component of the housing so as to allow repair or cleaning, for example. On the one hand, the presence of the elongated intermediate component in the suction head disables a known option according to which the one brush wets the other brush during operation, but on the other hand, the elongated intermediate component may have a function in facilitating liquid supply, and also in preventing pollution of internal surfaces of the suction head. In particular, it may be so that the wetting arrangement is further arranged and configured to enable a direct supply of liquid from at least one position on the elongated intermediate component to at least one area of the surface to be cleaned. This at least one position on the elongated intermediate component may be a position at a bottom side of the elongated intermediate component, and when the bottom side is arranged so as to be close to the surface to be cleaned, i.e. when the bottom side is at a level that is at least 2 mm and at most 6 mm above a level of the lowest position of the at least one wheel as suggested earlier, the above-described cleaning effect is realized on the bottom side.

In the context of the invention, the at least one brush may be of any type that is suitable to be used for picking up dirt from a surface to be cleaned. The brush may especially be designed to serve as an agitator, for example, agitating dirt particles as may be present on the surface. In a practical embodiment of the suction head according to the invention, the brush comprises a core element and flexible microfiber elements arranged on the core element. In such a brush, a linear mass density lower than 150 g per 10 km may be applicable to the microfiber elements, or at least tip portions thereof, so that the microfiber elements really can be highly flexible. The linear mass density as mentioned may even be lower than 10 g per 10 km, 5 g per 10 km or 1 g per 10 km. Such microfiber elements can be placed on the core element in a dense arrangement so as to very effectively interact with a surface to be cleaned during operation of the suction head. Further, it may be practical if such microfiber elements are arranged on the core element in tufts.

It is practical if an operational shape of the brush is generally the shape of a cylinder having a circular periphery, in other words, if the operational shape of the brush is generally the shape of a roller, which may be an elongated roller.

The invention further relates to a vacuum cleaner, particularly a cordless vacuum cleaner, comprising a suction head as defined and described in the foregoing, which is equipped with a wetting arrangement that is arranged and configured to enable a direct supply of liquid to the at least one wheel of the suction head. It is practical if such a vacuum cleaner comprises a reservoir that is configured to receive liquid, to contain liquid, and to let out liquid to the wetting arrangement of the suction head. Advantageously, the reservoir is removably arranged on the vacuum cleaner so that it is easy for a user to take the reservoir to a place where the reservoir can be filled with liquid.

The above-described and other aspects of the invention will be apparent from and elucidated with reference to the following detailed description of a practical embodiment of a suction head comprising a housing and two brushes arranged in the housing, and further comprising a wetting arrangement that is arranged and configured to enable a direct supply of liquid to the at least one wheel of the suction head.

BRIEF DESCRIPTION OF THE DRAWINGS

The invention will now be explained in greater detail with reference to the figures, in which equal or similar parts are indicated by the same reference signs, and in which.

DETAILED DESCRIPTION OF THE EMBODIMENTS

Figure 1:
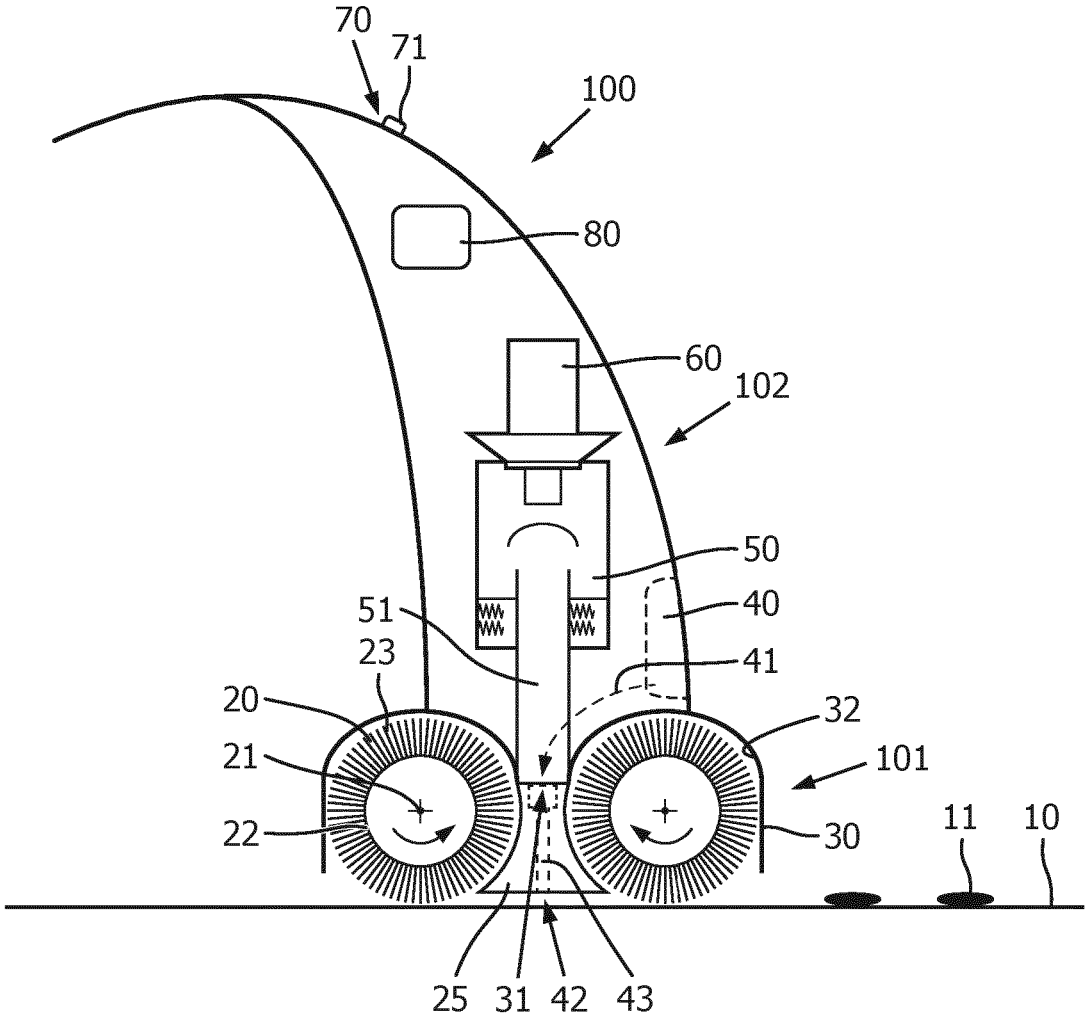
FIG. 1 diagrammatically shows components of a wet vacuum cleaner according to an embodiment of the invention and a portion of a floor having a surface to be cleaned, FIG. 2 diagrammatically shows a view of a longitudinal section of a suction head according to an embodiment of the invention, taken at a position between two brushes which are included in the suction head.
Figure 2:
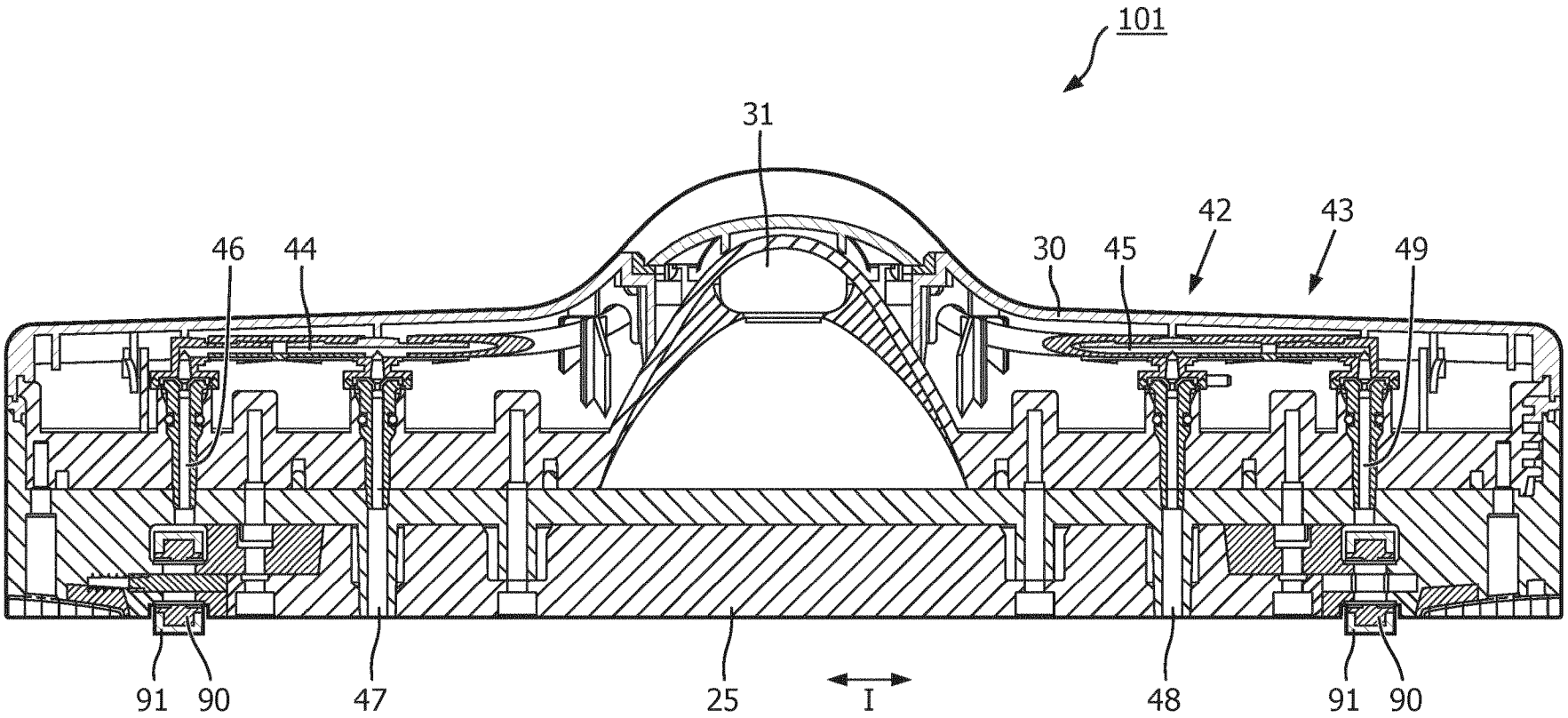
Figure 3:
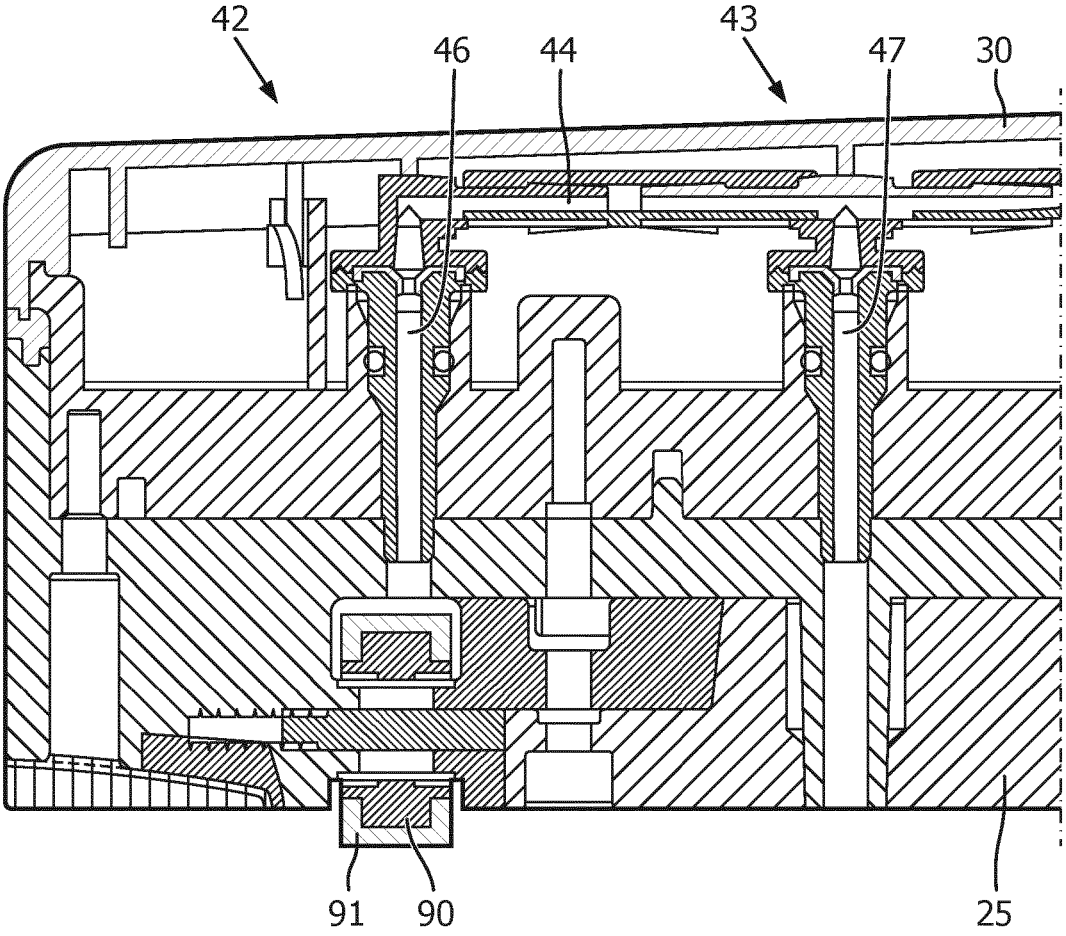
FIG. 3 shows an enlarged detail of FIG. 2, FIG. 4 diagrammatically shows a perspective top view of a portion of the suction head, FIGS. 5 and 6 diagrammatically show views of a cross-section of the suction head, taken at different longitudinal positions on the suction head.

FIG. 1 illustrates the design of a wet vacuum cleaner 100 according to an embodiment of the invention. The particular vacuum cleaner represented in FIG. 1 and described in the following is just one example of many types of vacuum cleaners which are feasible in the framework of the invention. In this respect, it is noted that the invention does not only relate to wet vacuum cleaners, but also to other types of vacuum cleaners such as wet/dry vacuum cleaners having a dry cleaning function besides a wet cleaning function.

The wet vacuum cleaner 100 is configured to be used for the purpose of subjecting a surface 10 such as a floor surface to a wet cleaning action. FIG. 1 shows the vacuum cleaner 100 in a normal, operational orientation relative to the surface 10 to be cleaned. The use in the present text of a term having an orientation aspect is to be understood in relation to this normal, operational orientation of the vacuum cleaner 100 relative to the surface 10 to be cleaned, wherein it is assumed that the surface 10 is at a bottom position and the vacuum cleaner 100 is placed on the surface 10.

At a side that is supposed to face the surface 10 during operation of the vacuum cleaner 100, the vacuum cleaner 100 comprises a suction head 101 accommodating two brushes 20 which are configured to interact with the surface 10 during operation of the vacuum cleaner 100. In the following, it is assumed that each of the brushes 20 is provided in the form of a roller that is rotatable about a rotation axis 21 that is defined by a central longitudinal axis of the roller, and that each of the brushes 20 comprises a core element 22 and flexible microfiber elements 23 arranged on the core element 22, which does not alter the fact that other embodiments of the brushes 20 are possible as well. The brushes 20 may be identical, but this is not necessary in the context of the invention. As indicated in FIG. 1 by means of curved arrows depicted at the position of the brushes 20, the brushes 20 are arranged so as to be rotatable in opposite directions with respect to each other about their respective rotation axes 21. In the framework of the invention, the suction head 101 may accommodate another number of brushes 20, wherein it is particularly to be noted that having just a single brush 20 is a feasible alternative option. The suction head 101 comprises a housing 30 that is configured to partially cover the brushes 20. The housing 30 can be made of a plastic material, for example.

Besides the suction head 101, the vacuum cleaner 100 comprises a body portion 102 that is configured to be taken hold of by a user of the vacuum cleaner 100. Preferably, the suction head 101 and the body portion 102 are removably couplable to each other. The body portion 102 can be shaped in any appropriate way. The outline of the body portion 102 as shown in FIG. 1 is of a diagrammatical nature only. It is practical if the body portion 102 comprises a handle so that a user can easily take hold of the body portion 102 and move the vacuum cleaner 100 across the surface 10 to be cleaned as desired. The suction head 101 comprising a supporting mechanism (not shown in FIG. 1) that is configured to enable the suction head 101 to be supported on the surface 10 to be cleaned and to be moved back and forth on the surface 10. In the context of the invention, such a supporting mechanism comprises at least one wheel.

For the purpose of driving the brushes 20 during operation of the vacuum cleaner 100, the vacuum cleaner 100 is equipped with a suitable electric drive mechanism (not shown). For the purpose of powering the drive mechanism and probably also other components of the vacuum cleaner 100, the vacuum cleaner 100 may be connectable to the mains and/or may be equipped with a suitable battery arrangement. Preferably, the vacuum cleaner 100 is a cordless device comprising a rechargeable battery arrangement, in which case it may further be practical if the vacuum cleaner 100 is part of a set including a charging dock besides the vacuum cleaner 100. Such a set may also include a flushing tray that can be used for the purpose of cleaning the brushes 20. In case the vacuum cleaner 100 is not equipped with a battery, a simple dock that is without charging ability may be provided for receiving and holding the vacuum cleaner 100 while the vacuum cleaner 100 is not being operated.

The body portion 102 of the vacuum cleaner 100 includes a liquid reservoir 40 that serves for containing a liquid such as water or a mixture of water and a cleaning agent, and a liquid supply mechanism 41 that serves for supplying the liquid to a wetting arrangement 42 of the suction head 101 during operation of the vacuum cleaner 100. The liquid supply mechanism 41 may comprise any suitable type of pump arrangement, for example, or may be configured to enable displacement of the liquid as desired under the influence of gravity. In the shown example, the wetting arrangement 42 of the suction head 101 is arranged and configured to enable both a direct supply of liquid to areas of the surface 10 to be cleaned and a direct supply of liquid to two wheels 90 of the suction head 101 (see FIGS. 2, 3, 5 and 6), as will be explained later in more detail. In case the suction head 101 comprises more than those two wheels 90, it may not be necessary to enable a direct supply to the additional wheels as well, especially if those wheels are at a trailing position and less prone to pollution.

Further, in the shown example, the suction head 101 comprises an elongated intermediate component 25 that is located in an area between the brushes 20 and that comprises two concavely curved portions configured to cover portions of the brushes 20, and the wetting arrangement 42 comprises a conduit system 43 that is partially arranged in the elongated intermediate component 25 and that is configured to transport the liquid and to let out the liquid to the areas of the surface 10 and to the two wheels 90. In FIG. 1, the liquid reservoir 40, the liquid supply mechanism 41 and the wetting arrangement 42 of the suction head 101 are indicated by means of dotted lines. It is practical if the liquid reservoir 40 is removably coupled to the body portion 102 so that a user is enabled to separate the liquid reservoir 40 from the body portion 102 when it is desired to take the liquid reservoir 40 to a place where the liquid reservoir 40 is to be filled with liquid.

Figure 4:
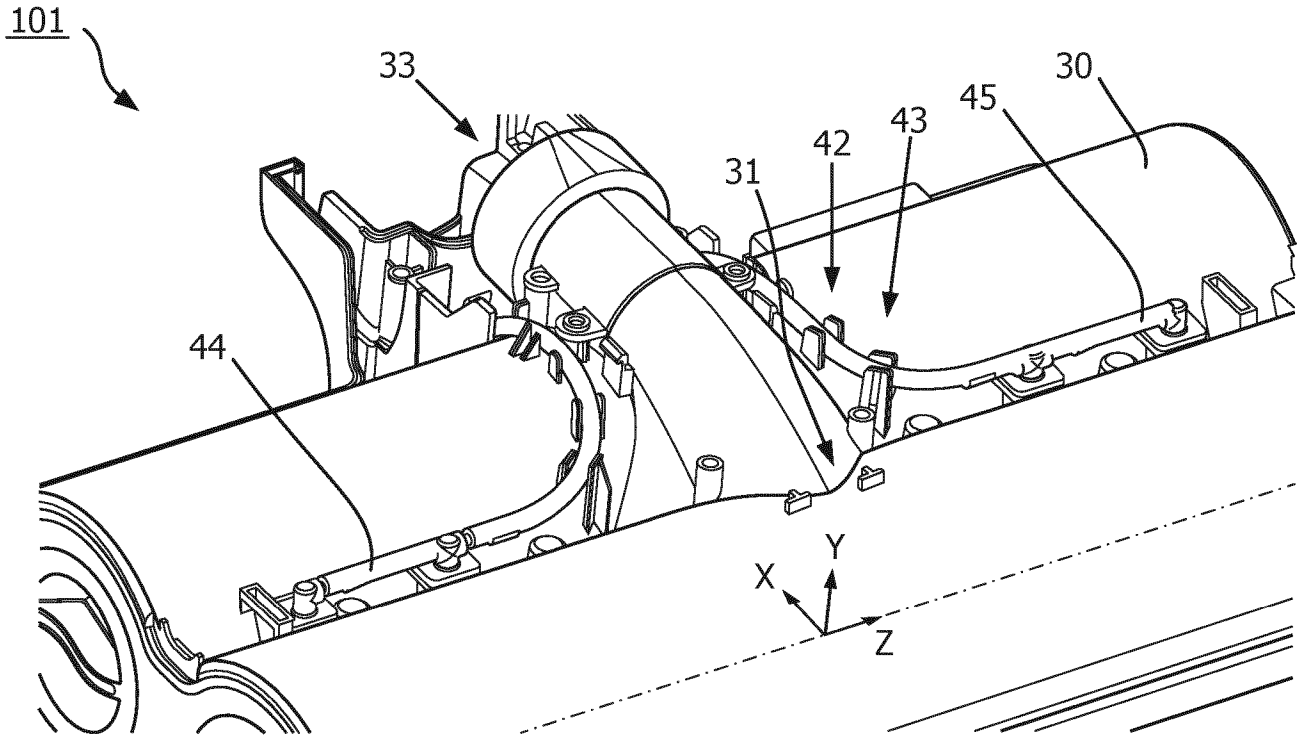

The body portion 102 of the vacuum cleaner 100 further includes a dirt reservoir 50 that serves for receiving and accumulating wet dirt 11 that is picked up from the surface 10 by the brushes 20 during operation of the vacuum cleaner 100. The dirt reservoir 50 can be configured in numerous ways as conventionally available for accumulating wet dirt from the incoming dirt 11 that is picked up from the surface 10 such as for instance a cyclonic arrangement or a tube-in-cup arrangement. The body portion 102 includes a vacuum mechanism 60 configured to create underpressure that is functional to enable transport of the dirt 11 from the area where the brushes 20 are located to the dirt reservoir 50 in the body portion 102, through an outlet opening 31 in a surface 32 of the housing 30 facing the brushes 20 and a suction channel 51 extending from the outlet opening 31 to the dirt reservoir 50. As can be seen in the view of the portion of the suction head 101 in FIG. 4, the housing 30 includes a coupling area 33 that is configured to enable coupling of the housing 30 to the assembly of the suction channel 51, the dirt reservoir 50 and the vacuum mechanism 60 in the body portion 102 of the vacuum cleaner 100. The outlet opening 31 is in fluid communication with this coupling area 33.

Basic aspects of the way in which the wet vacuum cleaner 100 is operated are as follows. During operation, the brushes 20 are driven so as to rotate and the liquid supply mechanism 41 is activated so as to supply liquid to the wetting arrangement 42 of the suction head 101 so that liquid may be let out to the surface 10 to be cleaned and to the two wheels 90. Any stains as may be present on an area of the surface 10 that is within reach of the brushes 20 are detached under the influence of the liquid and agitation by the brushes 20, and dirt particles and dust as may be present on the area of the surface 10 are removed along with the liquid and conveyed to the dirt reservoir 50, passing through the outlet opening 31 and the suction channel 51 in the process. The dirt 11 is picked up from the surface 10 by tip portions of the microfiber elements 23 of the brushes 20 and is flung away from the tip portions as the brushes 20 rotate, at a position where the tip portions move out of contact to the surface 10.

As illustrated in FIG. 1, the vacuum cleaner 100 may be equipped with a user interface 70, which user interface 70 may include an on/off button 71, for example. The vacuum cleaner 100 may further comprise a controlling system 80 including a microcontroller that is programmed to put the brushes 20 in motion and to activate both the liquid supply mechanism 41 and the vacuum mechanism 60 in reaction to input received from the user through the user interface 70 to that end.

FIGS. 2-8 serve to illustrate aspects of a suction head 101 according to an embodiment of the invention, especially aspects of the wetting arrangement 42 of the suction head 101. It can be seen in FIGS. 2 and 4 that the conduit system 43 of the wetting arrangement 42 comprises two main conduits 44, 45 which are located in different halves of the suction head 101 as seen in a longitudinal direction/being the direction which the rotation axes 21 of the brushes 20 extend, and which are couplable to the liquid supply mechanism 41. Further, the conduit system 43 comprises four branch conduits 46, 47, 48, 49, namely, as seen from left to right in FIG. 2, i) a branch conduit 46 that is coupled to a first one 44 of the main conduits 44, 45, that is configured to let out liquid to one of the wheels 90, and that extends from the first one 44 of the main conduits 44, 45 to the wheel 90, ii) a branch conduit 47 that is also coupled to the first one 44 of the main conduits 44, 45, at a longitudinal position more or less between the wheel 90 and the outlet opening 31, that is configured to let out liquid to a first area of the surface 10 to be cleaned, and that extends from the first one 44 of the main conduits 44, 45 to the surface 10, iii) a branch conduit 48 that is coupled to a second one 45 of the main conduits 44, 45, at a longitudinal position more or less between another wheel 90 and the outlet opening 31, that is configured to let out liquid to a second area of the surface 10 to be cleaned, and that extends from the second one 45 of the main conduits 44, 45 to the surface 10, and iv) a branch conduit 49 that is also coupled to the second one 45 of the main conduits 44, 45, that is configured to let out liquid to the other wheel 90, and that extends from the second one 45 of the main conduits 44, 45 to the wheel 90. The branch conduits 47, 48 which are configured to let out liquid to the surface 10 to be cleaned are arranged to partially extend through the elongated intermediate component 25, and the positions where the liquid is let out to the surface 10 are at a bottom side of the elongated intermediate component 25.

Letting out liquid to the wheels 90 during operation of the suction head 101 results in keeping the wheels 90 clean, so that any negative influences on the results of the action of cleaning the surface 10 following from the fact that the surface 10 is contacted by the wheels 90 are avoided. It can be seen in FIGS. 2 and 3 that the position at which the liquid is let out to a wheel 90 is a position right above the wheel, such that the liquid can be received by the wheel 90 at the position of the tread 91 thereof. Letting out liquid to the surface 10 at positions which are distributed along the brushes 20 in the longitudinal direction/is a factor in achieving that the brushes 20 are sufficiently wetted, without any dry or nearly-dry areas which might render the cleaning action less effective.

Figure 5:
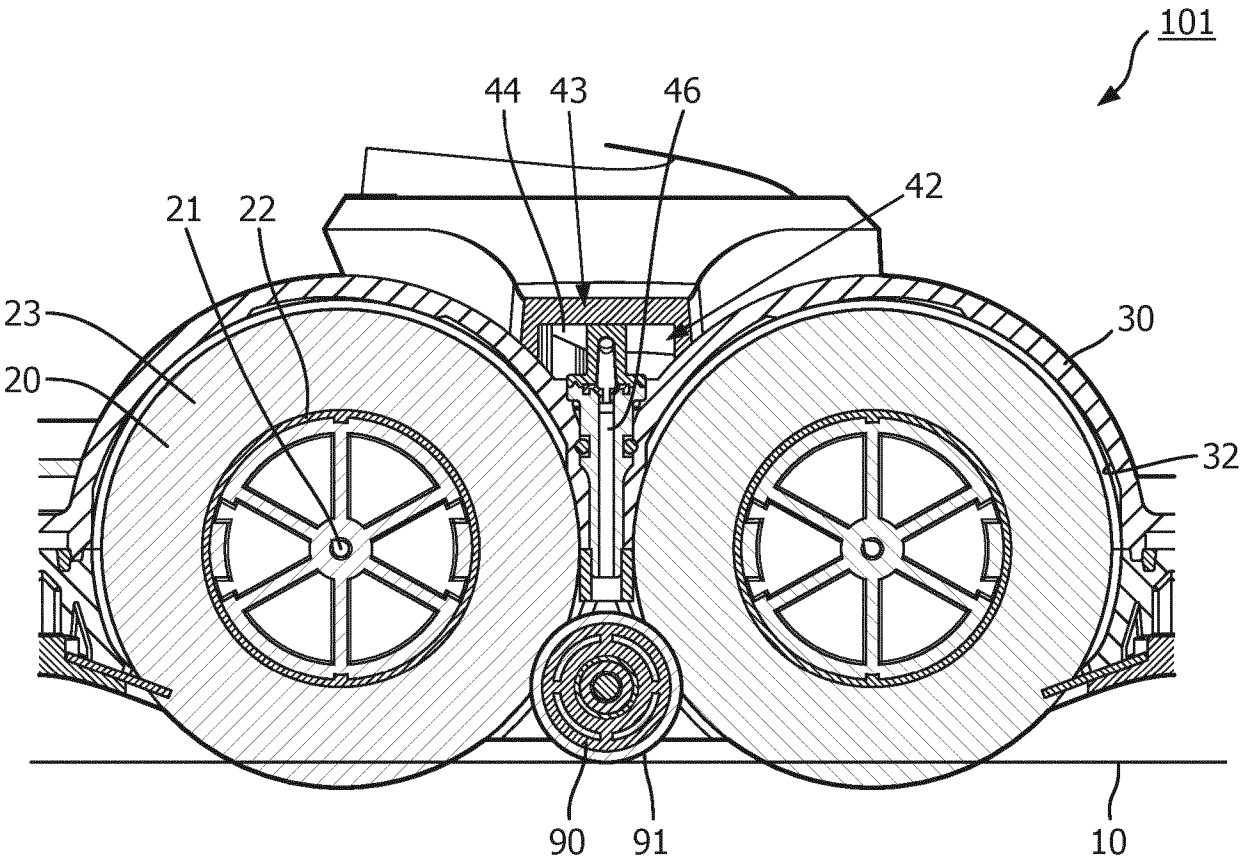

FIG. 5 shows another advantageous aspect of the design of the suction head 101 according to the embodiment of the invention, which resides in the fact that each of the two wheels 90 is arranged so as to be in contact with the brushes 20, especially with the microfiber elements 23 of the brushes 20. In the first place, this contributes to keeping the wheels 90 clean. In the second place, this contributes to realizing that the brushes 20 are wetted along their length, i.e. their dimension in the longitudinal direction 1.

Figure 6:
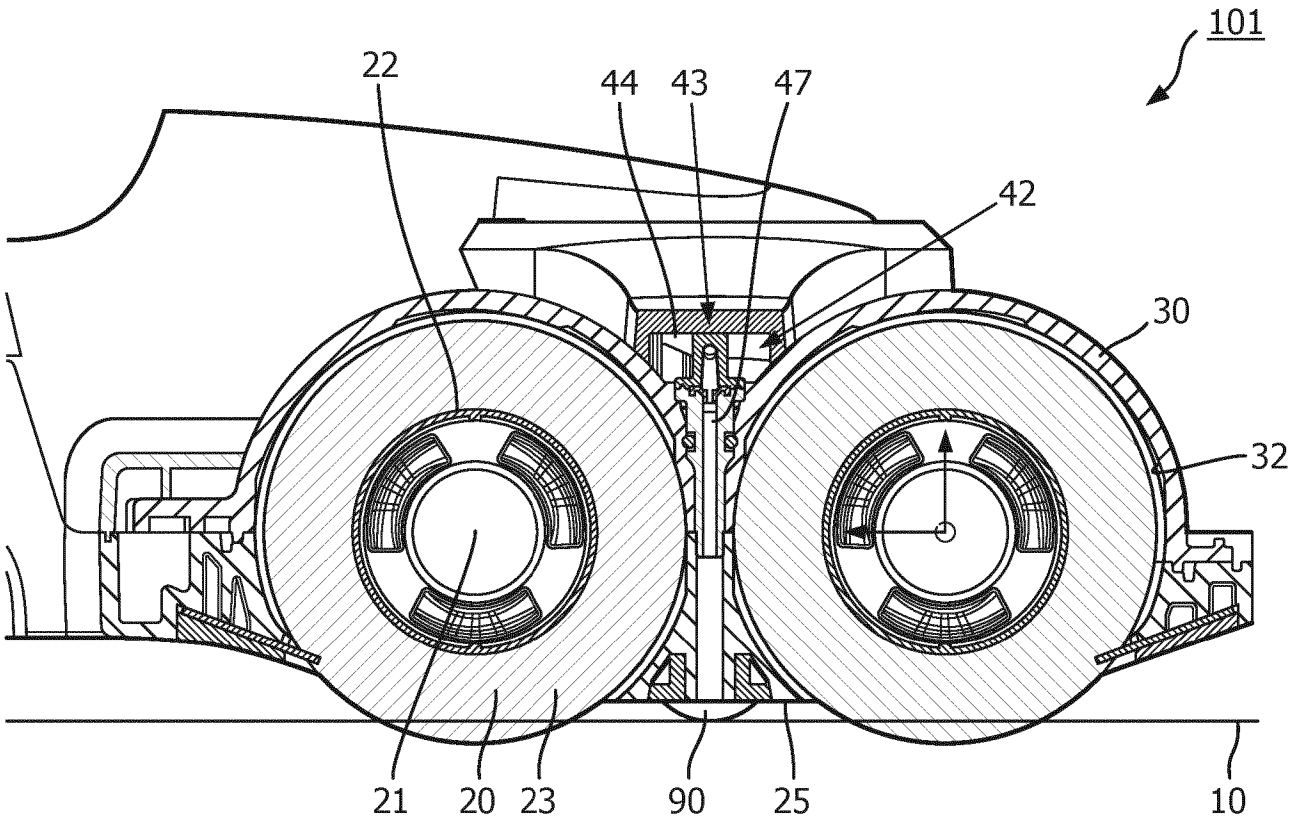

FIG. 6 illustrates the advantageous option of the wetting arrangement 42 being arranged and configured to let out liquid to at least one area of the surface 10 to be cleaned at a position of a bottom surface portion of the suction head 101 being at a level that is at least 2 mm and at most 6 mm above a level of the lowest position of the at least one wheel 90 of the suction head 101, i.e. above a level of the surface 10 to be cleaned when the suction head 101 is in an operational position on the surface 10. By having only a small space between the surface 10 and the bottom surface portion of the suction head 101, it is achieved that the bottom surface portion of the suction head 101 is effectively kept clean, because the bottom surface portion is not exposed to the dirt 11 that is flung away by the brushes 20 and liquid can bridge the distance by surface tension. In this respect, it is noted that it is advantageous if the bottom side of the elongated intermediate component 25 is at the low level as well.

On the basis of the foregoing, an overview of the advantageous aspects of the small space between the surface 10 to be cleaned and the bottom surface portion of the suction head 101, that may include the bottom side of the elongated intermediate component 25, is provided:

- The liquid beneath the bottom surface portion bridges with the surface 10 and cleans the bottom surface portion by means of the surface tension, capturing small dirt particles that could adhere to the bottom surface portion.
- The flow of clean liquid from the different positions at which the liquid is let out has a direct cleaning effect on the bottom surface portion, especially on the bottom side of the elongated intermediate component 25.
- The movement of the suction head 101 results in the area underneath the bottom surface portion being in constant interaction with the brushes 20.

It is further noted that it is advantageous if the surface 32 of the housing 30 facing the brushes 20 is arranged so as to cover the brushes 20 at only a minimal distance, as in that case, the suction force is effectively invoked in the suction head 101, as a result of which air speed along the surface 32 can be relatively high, which also contributes to keeping the surface 32 clean, besides the fact that there is practically no room where dirt might build up.

Figure 7:
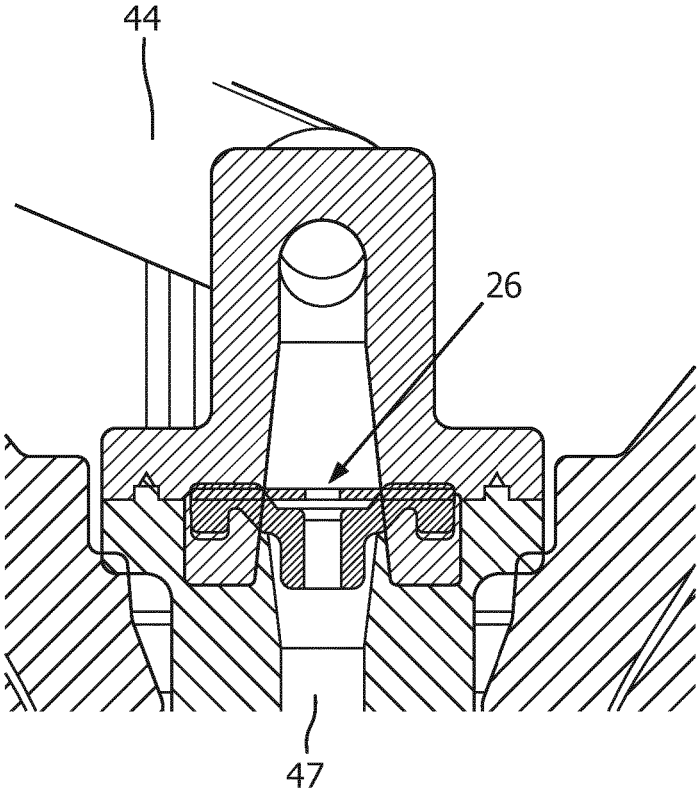
FIG. 7 shows an enlarged detail of FIG. 6.

In order to promote equal distribution of the liquid over the respective branch conduits 46, 47, 48, 49, it is practical if a restricted liquid passage 26 is present at an interface of the main conduits 44, 45 and the respective branch conduits 46, 47, 48, 49, as can best be seen in FIG. 7. The fact is that the restricted liquid passages 26 function to prevent drainage of the main conduits 44, 45 at the position of the branch conduit 47, 48 that comes first as seen in a downstream direction, which would hamper the supply of fluid to the other branch conduit 46, 49. Hence, on the basis of the presence of the restricted liquid passages 26, controlled retrieval of liquid from the main conduits 44, 45 at the positions where the branch conduits 46, 47, 48, 49 are coupled to the main conduits 44, 45 is realized.

Figure 8:
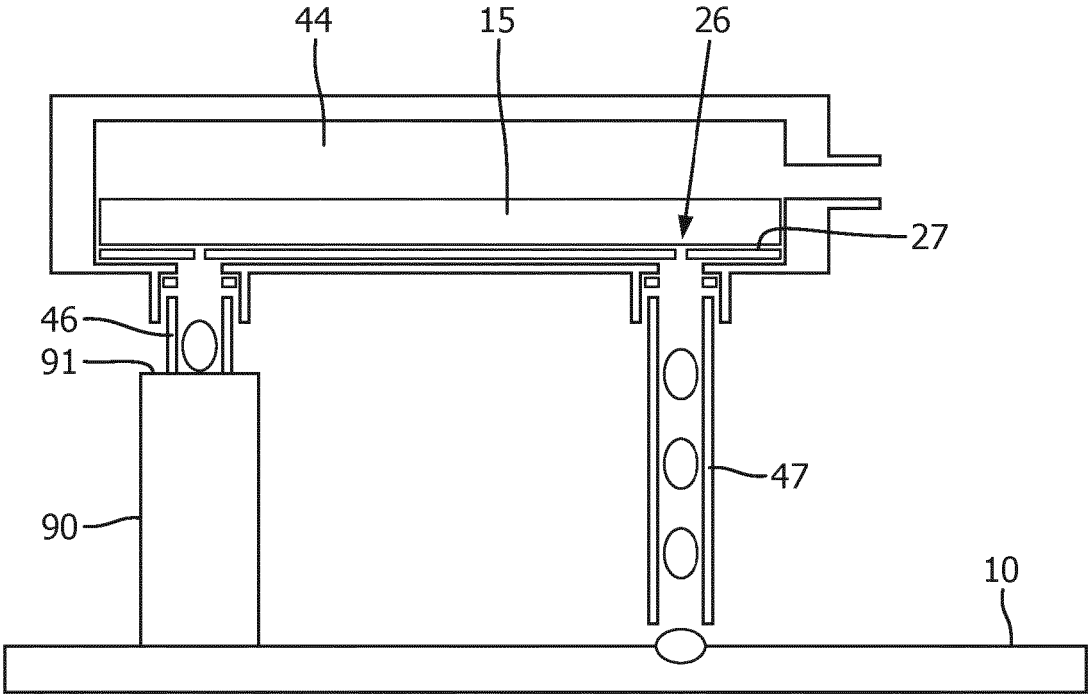
FIG. 8 illustrates an optional set-up of a conduit system of a wetting arrangement that is included in the suction head.

FIG. 8 illustrates an option according to which a main conduit 44 is more or less dimensioned so as to serve as a buffer of the liquid 15, and according to which a restriction element 27 is applied at the position where the respective branch conduits 46, 47 are coupled to the main conduit 44. In the shown example, the restriction element 27 comprises a strip that is provided with two restriction openings. The restriction openings are dimensioned so as to realize restricted liquid passages 26 which are configured to create a flow of droplets of the liquid 15 rather than a continuous flow. Preferably, the restriction element 27 or an assembly of components in which the restriction element 27 is included is removably arranged in the suction head 101 so that the restriction element 27 or the entire assembly may be removed by a user from time to time for cleaning purposes. Cleaning the restriction element 27 and possibly also adjoining components on a regular basis may especially be helpful in avoiding that the restriction openings get clogged and that the supply of liquid 15 to the wheels 90 and the surface 10 to be cleaned is thereby hindered.

Although both the option of directly supplying liquid 15 to the at least one wheel 90 and the option of directly supplying liquid 15 to at least one area of the surface 10 to be cleaned are illustrated and explained in the context of a single embodiment of the suction head 101 according to the invention, it is to be understood that the options can be applied independently. Further, as already suggested in the foregoing, there is no link between the options as mentioned, either alone or in combination, and the option of having an arrangement aimed at enabling interaction between at least one wheel 90 and at least one brush 20. Further, it is noted that additionally or alternatively to the option of directly supplying liquid 15 to at least one area of the surface 10 to be cleaned, an option of directly supplying liquid 15 to a position in the suction head 101, such as a position on the at least one brush 20, is feasible in the context of the invention. Generally speaking, the wetting arrangement 42 may be realized in any suitable way. For instance, it is possible to design the wetting arrangement 42 with a functionality to temporarily stop the supply of liquid to the at least one wheel 90 if so desired. This may be useful in view of a situation in which a type of surface 10 to be cleaned requires more than an average amount of liquid, this may allow a user to manually initiate a cleaning action of the at least one wheel 90 from time to time, etc.

When the suction head 101 comprises two brushes 20 and an elongated intermediate element 25 covering a portion of the brushes 20 from the bottom side of the suction head 101, as is the case in the shown embodiment of the suction head 101, it may be beneficial to use the elongated intermediate element 25 to accommodate at least a portion of one or more conduits of a conduit system 43 of the wetting arrangement 42, but this is not essential in the context of the invention.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

Notable aspects of the invention are summarized as follows. In the context of vacuum cleaning, a suction head 101 is provided, which is of the type comprising: a housing 30 that includes a coupling area 33 configured to enable coupling of the housing 30 to an air suction source 60 of a vacuum cleaner 100, at least one brush 20 that is rotatably arranged in the housing 30 and that is configured to interact with a surface 10 to be cleaned, and at least one wheel 90 that is rotatably arranged on the suction head 101 and that is configured to be in contact with the surface 10 to be cleaned. The suction head 101 is further equipped with a wetting arrangement 42 that is arranged and configured to enable a direct supply of liquid 15 to the at least one wheel 90 and to thereby achieve the effect that the at least one wheel 90 is kept wet during operation of the suction head 101 and the cleaning results of the surface 10 to be cleaned are optimized.

The invention claimed is:

1. A suction head configured to be applied in a vacuum cleaner and to perform a cleaning action on a surface, the suction head comprising:

a housing that includes a coupling area configured to enable coupling of the housing to an air suction source of the vacuum cleaner, at least one brush that is rotatably arranged in the housing, wherein the at least one brush is configured to interact with the surface to be cleaned, at least one wheel that is rotatably arranged on the suction head, wherein the at least one wheel is configured to be in contact with the surface to be cleaned, and a wetting arrangement that is arranged and configured to enable a direct supply of liquid to the at least one wheel.

2. The suction head of claim 1, wherein the wetting arrangement is arranged and configured to enable the direct supply of liquid to the at least one wheel at a position of a tread of the at least one wheel, from outside of the at least one wheel.

3. The suction head of claim 1, wherein the wetting arrangement comprises a conduit system configured to transport the direct supply of liquid and to let out the direct supply of liquid to the at least one wheel.

4. The suction head of claim 3, wherein the conduit system is configured to let out the direct supply of liquid to the at least one wheel at a position right above the at least one wheel.

5. The suction head of claim 3, wherein the conduit system comprises at least one main conduit and at least one branch conduit, and wherein the at least one branch conduit is coupled to the at least one main conduit and extends from the at least one main conduit towards the at least one wheel.

6. The suction head of claim 5, wherein a restricted liquid passage is present at an interface of the at least one main conduit and the at least one branch conduit.

7. The suction head of claim 5, comprising a restriction element in fluid communication with the at least one main conduit and the at least one branch conduit, wherein the restriction element is provided with at least one restriction opening configured to allow the direct supply of liquid to pass in a direction from the at least one main conduit towards the at least one branch conduit, and wherein the restriction element or an assembly of components in which the restriction element is included is removably arranged in the suction head.

8. The suction head of claim 1, wherein the at least one wheel is arranged so that the at least one brush is enabled to interact with the at least one wheel during operation of the suction head.

9. The suction head of claim 1, comprising at least two wheels, wherein the wetting arrangement is arranged and configured to enable the direct supply of liquid to at least some of the wheels.

10. The suction head of claim 1, wherein the wetting arrangement is further arranged and configured to enable the direct supply of liquid to at least one area of the surface to be cleaned.

11. The suction head of claim 10, wherein the wetting arrangement is arranged and configured to let out the direct supply of liquid to the at least one area of the surface to be cleaned at a position of a bottom surface portion of the suction head being at a level that is at least 2 mm and at most 6 mm above a level of a lowest position of the at least one wheel.

12. The suction head of claim 1, comprising two brushes in a substantially parallel arrangement, wherein the at least one wheel is located in an area between the brushes.

13. The suction head of claim 12, comprising an elongated intermediate component that is located in the area between the brushes, wherein the elongated intermediate component comprises two portions configured to cover portions of the brushes.

14. The suction head of claim 13, wherein the wetting arrangement is further arranged and configured to enable the direct supply of liquid from at least one position on the elongated intermediate component to at least one area of the surface to be cleaned.

15. A cordless vacuum cleaner, comprising the suction head of claim 1.

* * * * *